US005303863A

United States Patent [19]

Arasim

[11] Patent Number: 5,303,863

[45] Date of Patent: Apr. 19, 1994

[54] BEVERAGE CARTON WITH INTEGRAL COOLER BIN

[76] Inventor: James D. Arasim, 5225 Richmond Dr., Racine, Wis. 53406

[21] Appl. No.: 771,311

[22] Filed: Oct. 2, 1991

[51] Int. Cl.[5] ..... B65D 5/24

[52] U.S. Cl. ..... 229/227; 229/101; 229/103; 229/222; 229/229; 206/542

[58] Field of Search ..... 229/101, 103, 210, 221, 229/222, 224, 227, 228, 229; 206/542; 62/371, 457.4, 457.5

[56] References Cited

U.S. PATENT DOCUMENTS

| | | | |
|---|---|---|---|
| 1,861,206 | 5/1932 | Burgess | 229/101 X |
| 2,563,619 | 8/1951 | Ringler | 229/140 |
| 2,648,954 | 8/1953 | Wheeler et al. | 62/91.5 |
| 2,807,402 | 9/1957 | Nelbach | 62/80 |
| 2,810,506 | 10/1957 | Kessler | 229/101 |
| 2,989,176 | 6/1961 | Hasselhoff | 206/65 |
| 2,998,178 | 8/1961 | Jacke | 229/138 X |
| 3,006,165 | 10/1961 | Mittelberger | 62/371 |
| 3,118,533 | 1/1964 | Curtis | 206/45.32 |
| 3,119,494 | 1/1964 | Rosenstiel | 206/46 |
| 3,144,130 | 8/1964 | Copping | 206/65 |
| 3,217,874 | 11/1965 | Potter | 206/65 |
| 3,286,900 | 11/1966 | Keith | 229/138 X |
| 3,401,535 | 9/1968 | Palmer | 62/457 |
| 3,462,010 | 8/1969 | Hamilton et al. | 206/65 |
| 3,539,093 | 11/1970 | Massengill | 229/101.2 X |
| 3,565,320 | 2/1971 | Osborne et al. | 229/14 |
| 3,605,435 | 9/1971 | Taylor | 62/457 |
| 3,734,390 | 5/1973 | Buttery et al. | 229/227 |
| 3,735,916 | 5/1973 | Buttery | 229/227 |
| 3,848,766 | 11/1974 | Ganti et al. | 220/9 F |
| 3,897,872 | 8/1975 | Graser | 206/146 |
| 3,974,658 | 8/1976 | Starrett | 62/60 |
| 4,014,292 | 3/1977 | Coughlin et al. | 229/101 X |
| 4,020,986 | 5/1977 | McAtee | 224/42.42 R |
| 4,242,884 | 1/1981 | Kotschwar | 62/371 |
| 4,295,345 | 10/1981 | Atkinson | 62/371 |
| 4,328,923 | 5/1982 | Braser | 229/101 |
| 4,478,334 | 10/1984 | Graser | 206/427 |
| 4,530,459 | 7/1985 | Maroszek | 229/140 X |
| 4,607,502 | 8/1986 | Tomac | 62/294 |
| 4,721,237 | 1/1988 | Leslie | 224/148 |
| 4,804,083 | 2/1989 | Weeks | 206/216 |
| 4,821,525 | 4/1989 | Drummond, III et al. | 62/56 |
| 4,930,680 | 6/1990 | Hanus | 229/138 X |
| 4,974,731 | 12/1990 | Wood | 206/607 |
| 5,020,337 | 1/1991 | Krieg | 62/464 |
| 5,054,644 | 10/1991 | Greenslade | 229/131.1 X |

*Primary Examiner*—Allan N. Shoap
*Assistant Examiner*—Christopher McDonald
*Attorney, Agent, or Firm*—Jansson & Shupe, Ltd.

[57] ABSTRACT

The invention is an improvement in a carton of the type having a compartment for multiple containers of beverage and means for holding a coolant such as ice in heat exchange relationship to containers, e.g., cans. In the improved carton, the holding means includes a plurality of panels in stacked relationship to one another in a repose position, i.e., when the carton is in the "as sold" configuration. In such configuration, the carton main compartment is of substantially conventional size to hold, for example, twelve or twenty-four 12 oz. cans of beverage. When the user desires to chill the cans (or keep them chilled), the panels are unfolded to a utility position to form an ice bin atop the compartment. Ice is poured into the bin and cans are cooled by direct contact with the ice. By first withdrawing plural cans from the compartment, pouring in ice and then nestling the withdrawn cans back into the bin-contained ice, many or all cans are in direct cooling contact with the ice. A carton blank and method for using the improved carton are also disclosed.

19 Claims, 4 Drawing Sheets

FIG. 1
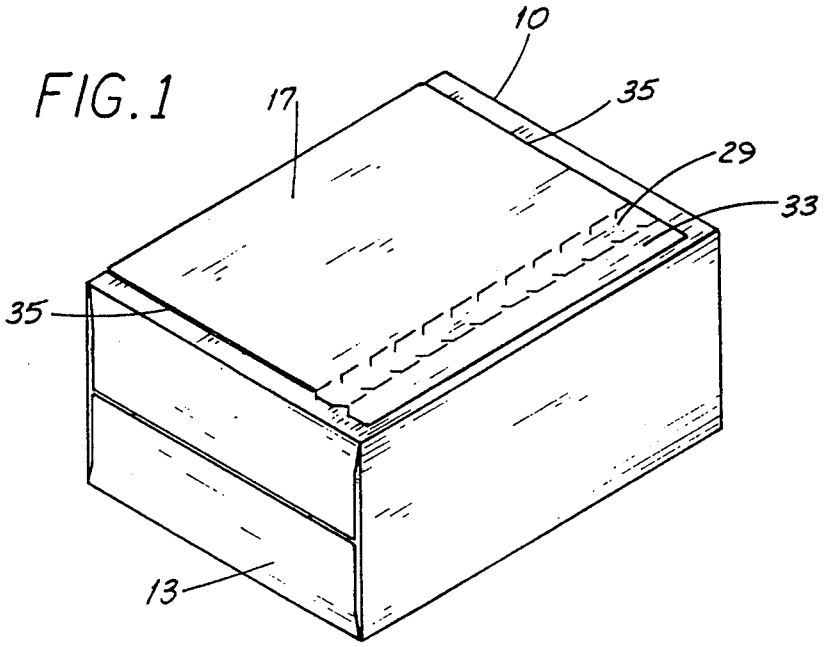
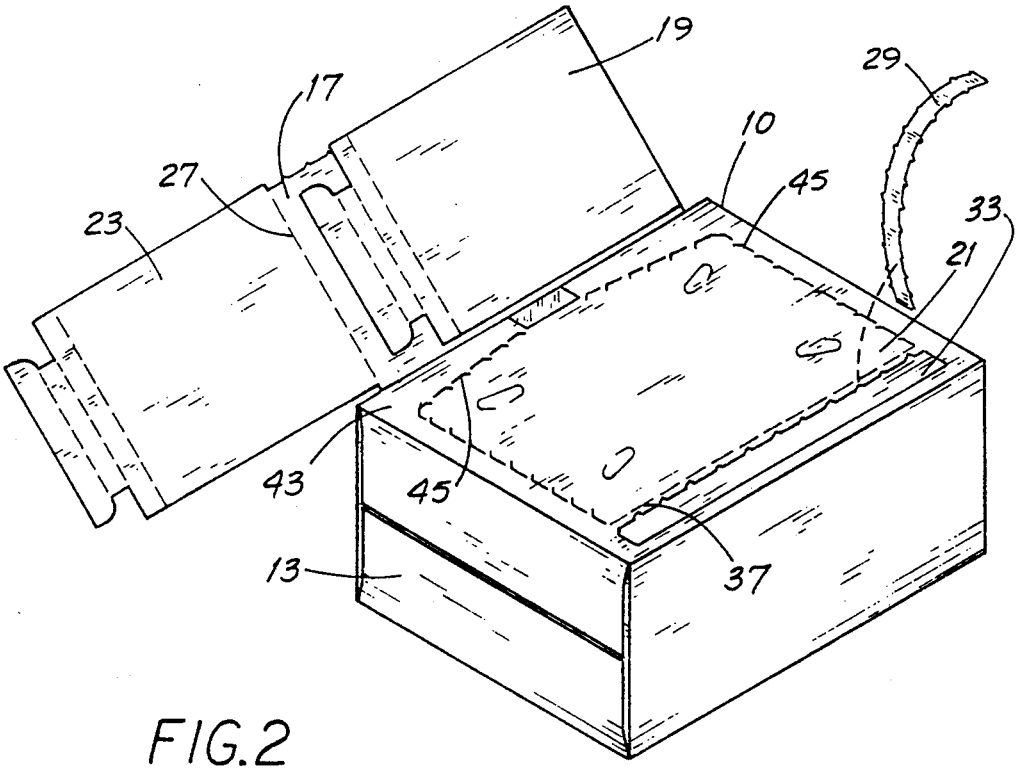
FIG. 2

BEVERAGE CARTON WITH INTEGRAL COOLER BIN

FIELD OF THE INVENTION

This invention is related generally to beverage cartons and, more particularly, to such cartons for packaging multiple beverage containers and having means to cool the containers.

BACKGROUND OF THE INVENTION

Beverages such as soda and beer are commonly sold in "personal" or single-serving size containers such as 12 oz. cans or bottles. Beverage producers usually package a number of such containers together for sale as a group. "Six-packs" are an example and in this type of package, the containers are substantially fully exposed, being held together only by a plastic strap and/or plastic "necklace."

Producers also put up multiple containers, usually cans, in 12- or 24-can cartons containing, respectively, a 4×3 or 6×4 "matrix" of individual cans. The former is a particularly popular size and is sold in very high quantities. The 12-can carton is often thought to be more convenient for "portable use" since it includes sufficient cans to serve more than one or two persons but at the same time, its modest weight and bulk make it very easy to carry.

During warmer months, canned beverages (which are often cooled at the point of purchase) will quickly become warm unless consumed rather soon thereafter. In consequence, consumers who wish to keep the beverage cool for extended periods during warm weather (or to cool beverages purchased at room temperature) while at the same time retaining "portability" must repackage the cans into a larger but portable container to which ice is added. And, typically, the larger container is of styrofoam or rigid plastic, is intended for repeated use and has significant value; that is, such container is clearly not disposable.

An example of a carton which can be used to cool containers is shown in U.S. Pat. No. 5,020,337 (Krieg). The primary purpose of the illustrated waterproof carton is as a receptacle in which ice, not beverage, is packed for sale. The top of the carton folds open and locks together to form a platform with openings through which the beverage container can be inserted while the beverage is being consumed. All panels used to form the platform are folded at least once when the carton is configured for sale. And all such panels are connected to the "parent" carton beneath. The patent explains that the carton can be used to package soda and beer at the point of sale and separately-purchased ice added later.

When used as a "point of sale" package, the carton is undoubtedly closed and sealed. If ice is later added, it is received in an upper region formed when the side and end flaps are unfolded. The side flaps (which are exposed to view when the carton is closed) and the end flaps are inter-connected to form a continuous, four-sided wall. Because of such interconnection, all flaps must be folded up or down simultaneously. And if the carton is used as described, i.e., folded shut to provide a can "caddy," one must manipulate the flaps to gain access to the carton interior.

Another arrangement for cooling packaged beverage cans is shown in U.S. Pat. No. 3,462,010 (Hamilton et al.). The cans are on a cardboard support and surrounded by a shrink-wrap plastic bag. The bag is sufficiently high that it can be opened, ice placed within it and the bag retied for container cooling.

A somewhat different arrangement is shown in U.S. Pat. No. 2,989,176 (Hasselhoff). This patent discloses a special receptacle in which containerized products and ice are simultaneously shipped. In its "as made" state, the volumetric capacity of the carton is significantly greater than that used to confine the product alone.

A two-piece refrigerated shipping container is shown in U.S. Pat. No. 3,565,320 (Osborn et al.). The product to be cooled is placed around the perimeter of the main container and the refrigerant container is placed within the main container in a central area. When the carton flaps are folded shut, the mouth of the refrigerant container is open and accessible for reicing.

A disadvantage of the cartons or carton-like packages shown in the foregoing patents is that they are all "top loaded." Modern high speed packaging machinery used to package multiple cans or bottles of soda or beer requires a carton capable of being end loaded. That is, the individual containers are inserted horizontally, as a group, into a carton open end.

A disadvantage of the packages shown in the Krieg and Hamilton et al. patents is that when a coolant, e.g., cube ice, is in place, the interior of the main compartment is not readily accessible. That is, the user would likely need to manipulate flaps or a bag to grasp and remove a can of beverage from such compartment—a distinctly inconvenient arrangement.

Another disadvantage of the cartons shown in the Hasselhoff, Osborn et al. and Krieg patents is that the quantity of material, e.g., cardboard, used to make the carton is inordinately large. The cost is unnecessarily increased and this militates against convenient disposability.

OBJECTS OF THE INVENTION

It is an object of this invention to provide an improved carton overcoming some of the problems and shortcomings of the cartons of the prior art.

Another object of this invention is to provide an improved carton which is compact and of substantially conventional size in the "as sold" configuration.

Another object of this invention is to provide an improved carton which permits convenient access to the main container compartment even as the beverage is being cooled.

Still another object of this invention is to provide an improved carton having an easily-erected ice bin into which coolant such as ice is placed.

Yet another object of this invention is to provide an improved carton which is end loaded and yet has a beverage-cooling feature. These and other important objects will be apparent from the following descriptions and from the drawing.

SUMMARY OF THE INVENTION

The invention is an improvement in a carton of the type having a compartment for multiple containers of beverage and means such as a flexible bag or box for holding a coolant, ice for example, in heat exchange relationship to the containers. In this specification, ice is repeatedly mentioned as the coolant —and for cartons like the inventive carton, it is the most commonly-used coolant. Notwithstanding, it is understood that other types of coolant may also be used.

In the improved carton, the holding means includes a plurality of panels. When the carton is in the "as sold" configuration, the panels are in stacked relationship to one another in what is termed a repose position. That is, the panels generally lie flat one to another in such a way that the carton is of substantially conventional size. The panels are retained in such position by a convenient tearaway strip.

When the purchaser/user wishes to cool the containers (or to keep them cool), the panels are unfolded to what is termed a utility position and coupled together to form a free-standing bin. Such bin is positioned above and opens into the container compartment. Ice is poured into the bin and containers are cooled by direct contact with the coolant. The improved carton is particularly well adapted for use with "12 packs" or "24 packs" of canned beverage such as soda or beer.

In a highly preferred embodiment, the ice holding means includes at least three panels (and preferably four), at least one of which is unattached to any other panel when the panels are in the repose position. And not all of the panels are directly attached to the carton. In the preferred embodiment, only two of four panels are so attached —and at least one (and preferably both) of the remaining end panels are attached to the left side panel, preferably directly. As used herein, "directly attached" or similar terms means, for example, that a panel and the carton are integrally formed in a continuum rather than being attached to one another by, say, gluing or with other fastening means. As will become apparent, it is a distinct manufacturing and carton-forming convenience to reduce the number of pieces used to make the improved carton.

The panels used to make the ice bin are flat, i.e., generally planar irrespective of whether they are "stacked" in the repose position or arranged in the utility position to form the bin. Considered another way, no panel is folded to or toward itself in any panel position. However, individual panels are folded toward or in contact with other panels as described below. This arrangement helps reduce the number of folds required to be made in forming a carton from a blank and results in economies.

In the described embodiment, the ice bin is generally rectangular in cross-sectional shape. Therefore, it is convenient to identify the panels as the left and right side panels and the first and second end panels. And, of course, whether a panel is on the left or right side is a matter of viewing perspective.

The main container compartment has a top wall formed at least in part by one of the panels, preferably a side panel. This side panel, e.g., the right side panel, is scored along three edges and directly attached to the carton along the fourth edge. In the preferred embodiment, each of the end panels is directly attached along a lateral edge of the other side panel, e.g., the left side panel, and it may be said that such end panels and the left side panel are therefore contiguous. The bottom edge of the exemplary left side panel is directly attached to the carton and its top edge is free.

In the repose position, the end panels are folded inward toward and generally parallel with the left side panel to which they are attached. This "three-panel stack" lies adjacent to the right side panel which forms part of the compartment top wall. Such stack is retained in position by a tearaway strip as described in greater detail below.

To better describe how the panels are arranged in the utility position to form the ice bin, it is assumed (as above) that the left side panel is that to which the end panels are attached. It is also assumed that the carton is entirely filled with containers, the scoring along the edges of the right side panel is unbroken and the tearaway strip is in place.

To "set up" and use the ice bin, the tearaway strip is removed, thereby "releasing" the left side panel and the two end panels. The left side panel is folded upward along a fold line at the panel/carton juncture and the end panels are folded outward along respective fold lines at the end panel/side panel juncture. At this time, the end panels and left side panel are oriented generally vertical, normal to the compartment top wall and form three of the four bin sides. The scoring along the right side panel is then broken and such panel is folded upward to a vertical position. The end panels preferably have tabs which slip into and detachably engage slots in the right side panel and when so arranged, the panels are said to be in the utility position and form an open-topped bin. As used herein, "fold line" or similar phrases means a linear juncture of two parts of the carton where a fold occurs.

Plural containers are then withdrawn from the compartment through the open top of the bin, thereby leaving a space in the compartment. Ice is then poured into the bin and the space, preferably taking care to assure that ice flowing into the space contacts a surface of every exposed container remaining in the compartment. The withdrawn containers are then "nestled" into the bin-confined ice and plural containers are thereby cooled by direct contact with the ice. When pouring ice, the bin may be partly or entirely filled before placing the withdrawn containers into the bin. In the former instance, ice is poured over the containers to fill the bin. In the latter, the withdrawn containers merely sit on the ice.

In a 12-can carton, removal of the center pair of cans from a row of four cans creates a space bounded by the remaining ten cans. That is, the remaining ten cans will be in direct contact with any substance, like ice, which fills the space. The 24-can carton offers much the same direct-contact advantage if four or eight cans are removed.

More specifically, in one "standard" or conventional arrangement where the compartment holds twelve containers in a $4\times3$ matrix, two containers are withdrawn from the compartment before ice is poured and the remaining ten containers are immediately adjacent to the resulting space. After pouring the ice into the space and the bin, such withdrawn containers are nestled into the ice. In that way, all twelve containers are in direct contact with ice for improved cooling. In another conventional arrangement where the compartment holds twenty-four containers in a $6\times4$ matrix, four containers are withdrawn and subsequently nestled into the ice. Again assuming ice is poured into the space to contact exposed containers, well over a dozen containers (including those withdrawn) are in direct contact with ice. If eight containers are withdrawn and subsequently replaced on or in the ice, all twenty four containers are in direct ice contact.

In the preferred embodiment, the top wall of the carton (formed in part by the exemplary right side panel), has a first area. The bin, being somewhat smaller, has a bottom of a second area less than the first area. Conveniently, the bin for a 12-container carton is volumetrically sized to receive a standard bag of ice such as an 8 lb. bag. These are widely available at grocery stores, gasoline stations and the like. The bin for a 24-container carton may be similarly sized or made larger to hold, say, a 10 lb. bag of ice.

The carton with integral ice bin is preferably made from a one-piece, generally planar blank. The blank includes a first panel portion having fold lines, plural contiguous panels and a tearaway strip. As further described below, the first panel portion includes a side panel, e.g., the left or right side panel, and the two end panels. A compartment portion is attached, preferably directly, to the first panel portion and has fold lines and a second panel portion scored for fold-out separation to a utility position. The blank is folded along the fold lines to form a beverage carton of substantially conventional size. When the tearaway strip is removed, the second panel portion is folded out and the first panel portion is detachably engaged or coupled to the second panel portion to form the upstanding, open-top ice bin.

Further details of the improved carton are set forth below in the detailed description taken in conjunction with the drawing.

BRIEF DESCRIPTION OF THE DRAWINGS

FIG. 1 is a perspective view of the improved carton in the configuration in which it is sold (with containerized contents) to the retail customer.

FIGS. 2 and 3 are perspective views of the carton of FIG. 1 showing the coolant bin in sequential stages of partial erection for container cooling.

DETAILED DESCRIPTIONS OF THE PREFERRED EMBODIMENTS

Figure 3:
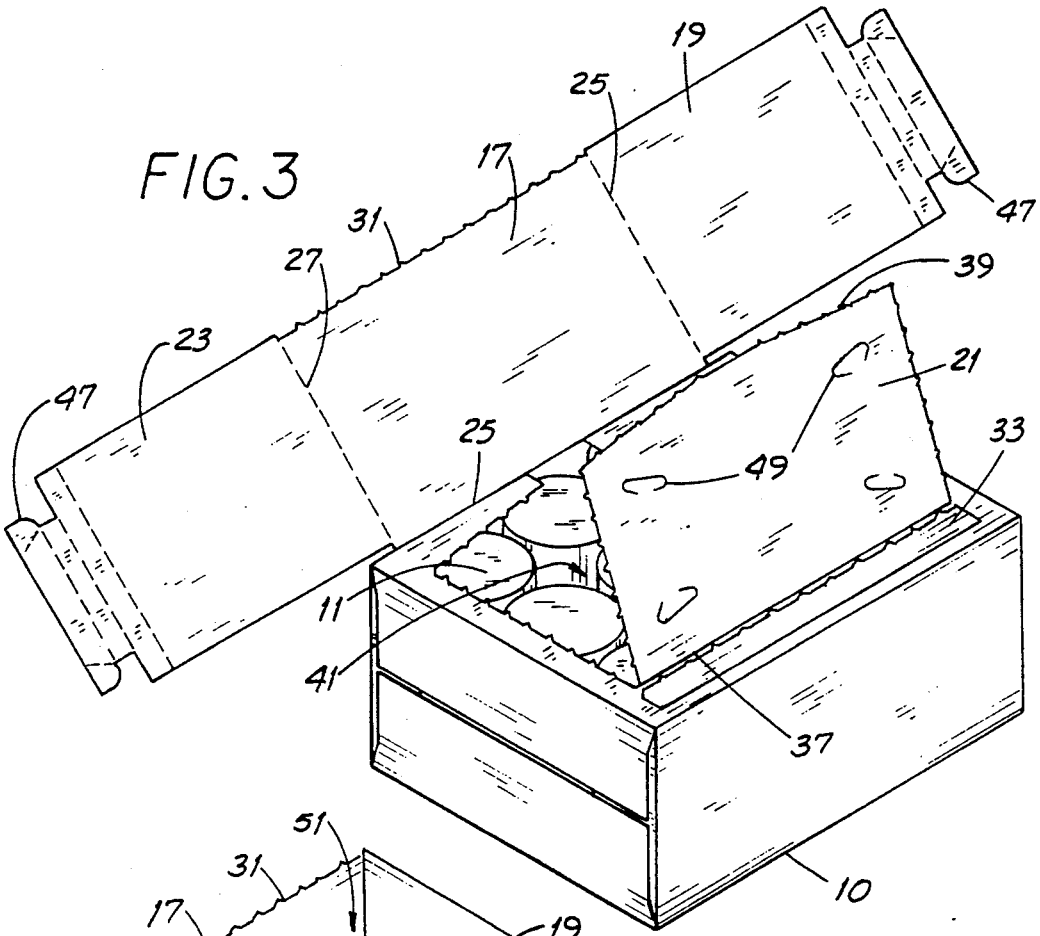

The inventive carton 10 is an improvement in multiple-container beverage cartons having means for holding a coolant, ice for example. FIGS. 1–4 and the related descriptions are based on the assumption that the carton 10 has earlier been filled with containers 11, e.g, a dozen 12 oz. beverage cans. Filling is by inserting twelve exemplary containers 11, as a group, into a carton open end and then sealing the end with glued end flaps 13.

FIGS. 1–4 depict the improved carton 10 in a sequence of views showing how the coolant holding means 15, an integral cooler bin 15*a*, is arranged and how its panels 17, 19, 21, 23 are set up for use. In the described embodiment, the cooler bin 15*a* is generally rectangular in cross-sectional shape. Therefore, it is convenient to identify the panels as the left and right side panels 17, 21, respectively and the first and second end panels 19, 23, respectively. And, of course, whether a panel is on the left or right side is a matter of viewing perspective.

In the "as sold" configuration shown in FIG. 1, the end panels 19, 23 are folded inward along fold lines 25, 27 to overlap against the left side panel 17. FIG. 2 shows how the end panel 19 is so folded. As shown in FIG. 1, these three panels 17, 19, 23 are atop and in general registry with the right side panel 21 and only the left side panel 17 is exposed. That is, the panels 19, 21, and 23 are concealed beneath the panel 17.

The panels 17, 19, 23 are retained in the position shown in FIG. 1 by a tearaway strip 29 joining the top edge 31 of the left side panel 17 and a retention strip 33 glued atop the carton 10. The panels 17, 19, 21, 23 are thereby in stacked relationship to one another in what is termed a repose position. That is, the panels 17, 19, 21, 23 generally lie flat one to another in such a way that the carton 10 is of substantially conventional size equal to that of an exemplary standard "12-pack" beverage carton without coolant holding means.

In a highly preferred embodiment, the holding means 15 includes at least three panels (and preferably four as illustrated), at least one of which is unattached to any other panel when the panels are in the repose position. As shown in FIG. 2 (where the right side panel 21 is still in its repose position), such panel 21 is not attached to any other panel 17, 19, 23.

And not all of the panels 17, 19, 21, 23 are directly attached to the carton 10. In the preferred embodiment, only two of four panels, the left and right side panels 17, 21, are so attached. Each of the end panels 19, 23 is directly attached to the left side panel 17 along a lateral edge 35. Attachment is preferably directly. The bottom edge 37 of the exemplary right side panel 21 is directly attached to the carton 10 and its top edge 39 is free. Such construction permits the panels 17, 19, 21, 23 to be manipulated generally independently of one another; that is, the panels 17, 19, 21, 23 are not coupled all together and need not be positioned in unison as is the case with some cumbersome prior art cartons.

Figure 4:
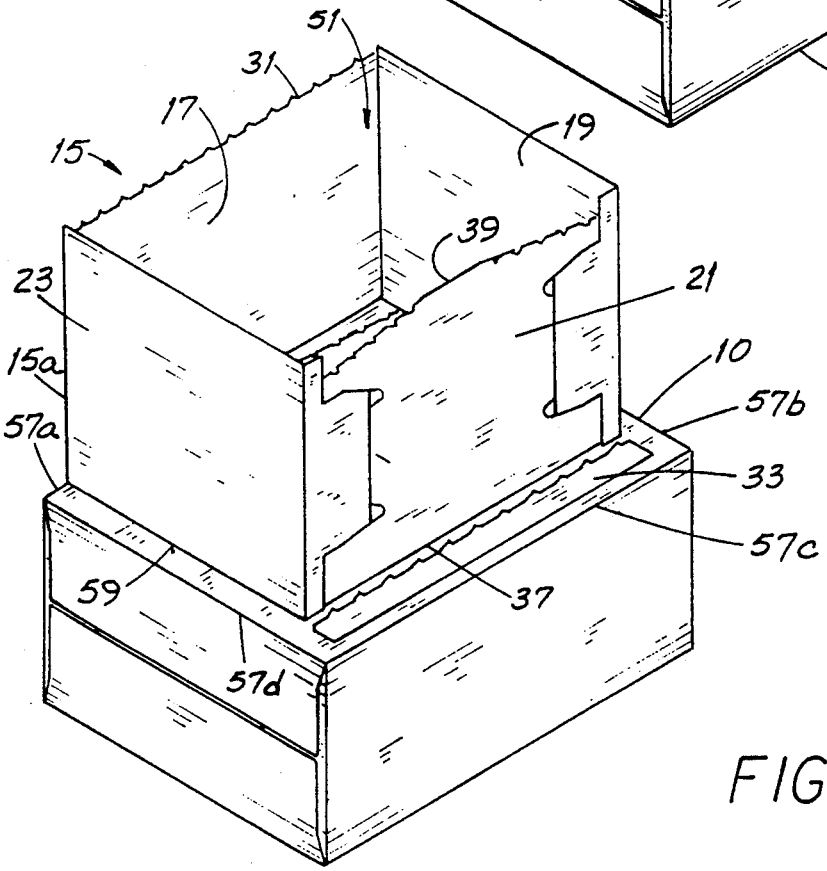
FIG. 4 is a perspective view of the carton of FIG. 1 showing the coolant bin fully erected to receive a coolant such as ice.

The panels 17, 19, 21, 23 used to make the ice bin 15*a* are flat, i.e., generally planar, irrespective of whether they are "stacked" in the repose position or arranged in the utility "bin-forming" position shown in FIG. 4. Considered another way, no panel 17, 19, 21, 23 is folded to or toward itself in any panel position but individual panels 17, 19, 23 are folded toward or in contact with other panels as described.

As best illustrated in FIGS. 2 and 3, the main container compartment 41 has a top wall 43 formed at least in part by one of the panels 17, 19, 21, 23, preferably a side panel 17 or 21. Such side panel, e.g., the right side panel 21, is scored along three edges and directly attached to the carton 10 along the fourth edge 37.

To describe how the panels 17, 19, 21, 23 are arranged in the utility position to form the ice bin 15*a*, it is assumed (as above) that the left side panel 17 is that to which the end panels 19, 23 are attached. It is also assumed that the carton 10 is in the "as sold" condition shown in FIG. 1, i.e., it is entirely filled with containers 11, the scoring 45 along the edges of the right side panel 21 is unbroken, the panels 17, 19 and 23 are against or adjacent to the panel 21 and the tearaway strip 29 is in place.

When the purchaser/user wishes to cool the containers 11 (or to keep them cool), the ice bin 15*a* is "set up"

for use. To do so, the tearaway strip 29 is removed, thereby "releasing" the left side panel 17 and the two end panels 19, 23. The left side panel 17 is folded upward along a fold line 25 at the panel/carton juncture and the end panels 19, 23 are folded outward along respective fold lines 25, 27 at the end panel/side panel juncture. When the panels 17, 19, and 23 are so positioned, they are oriented generally vertically, normal to the compartment top wall 43 and form three of the four bin sides. The scoring 45 along the right side panel 21 is then broken and such panel 21 is folded upward to a vertical position. The end panels 19, 23 preferably have tabs 47 which slip into and detachably engage slots 49 in the right side panel 21. When so arranged, the panels 17, 19, 21, 23 are said to be in the utility position and form an open-topped, semi-rigid bin 15*a* positioned above and opening into the container compartment 41.

Plural containers 11*a* are withdrawn from the compartment 41 through the open top 51 of the bin 15*a*, thereby leaving a space 53 in the compartment 41. Ice 55 is then poured into the bin 15*a* and the space 53, taking care to assure that ice 55 flowing into the space 53 contacts a surface of every exposed container remaining in the compartment 41. The withdrawn containers 11*a* are then "nestled" into the bin-confined ice 55 and plural containers 11, 11*a* are thereby cooled by direct contact with the ice 55. When pouring ice 55, the bin 15*a* may be partly or entirely filled before placing the withdrawn containers 11*a* into the bin. In the former instance, ice 55 is poured over the containers 11*a* to fill the bin 15*a*. In the latter, the withdrawn containers 11*a* merely sit on the ice 55.

Figure 5:
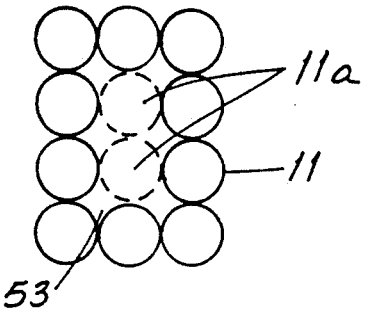
FIG. 5 is a representative top plan view of twelve beverage containers in a 4×3 matrix as such containers would be packaged in the carton of FIG. 1. Certain containers are shown in dashed outline.
Figure 7:
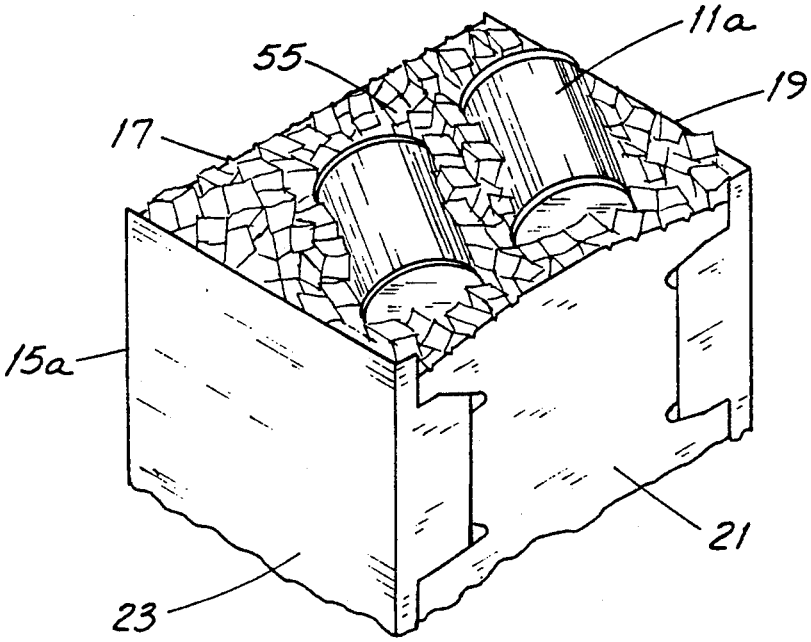
FIG. 7 is a perspective view of the erected bin (with parts broken away) filled with ice and having containers nestled in the ice.

Referring additionally to FIG. 5, in one "standard" or conventional arrangement where the compartment holds twelve containers 11, 11*a* in a 4×3 matrix, two containers 11*a* (as represented by dashed outline) are withdrawn from the compartment 41 before ice 55 is poured. The remaining ten containers 11 are immediately adjacent to the resulting space 53. After pouring the ice 55 into the space 53 and the bin 15*a*, such withdrawn containers 11*a* are nestled into the ice 55 as shown in FIG. 7. In that way, all twelve containers 11, 11*a* are in direct contact with ice 55 for improved cooling.

Figure 6:
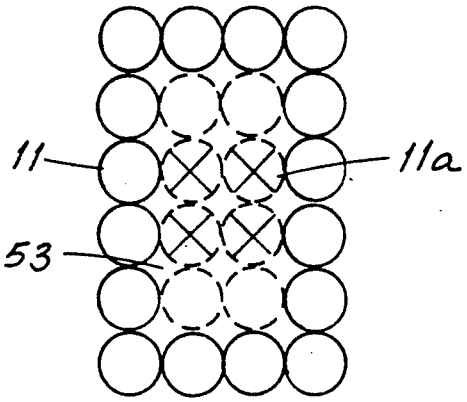
FIG. 6 is a representative top plan view of twenty four beverage containers in a 6×4 matrix as such containers would alternately be packaged in a larger carton like that of FIG. 1. Certain containers are shown in dashed outline.

Referring additionally to FIG. 6, in another conventional arrangement where the compartment 41 holds twenty-four containers in a 6×4 matrix, four containers 11*a* (those in dashed outline marked by "X") are withdrawn and subsequently nestled into the ice 55. Again assuming ice 55 is poured into the space 53 to contact exposed containers 11, well over a dozen containers 11, 11*a* (including those withdrawn) are in direct contact with ice 55. If eight containers 11*a* (those in dashed outline) are withdrawn and subsequently replaced on or in the ice 55, all twenty four containers 11, 11*a* are in direct ice contact.

In the preferred embodiment, the top wall 43 of the carton 10 (formed in part by the exemplary right side panel 21), has a first area bounded by the carton edges 57*a–d*. The bin 15*a*, being somewhat smaller, has a bottom perimeter 59 defining a second area less than the first area. Conveniently, the bin 15*a* for a 12-container carton 10 is volumetrically sized to receive a "standard" bag of ice such as an 8 lb. bag. These are widely available at grocery stores, gasoline stations and the like. The bin 15*a* for a 24-container carton 10 may be similarly sized or made larger to hold a larger but nevertheless standard bag of ice.

Figure 8:
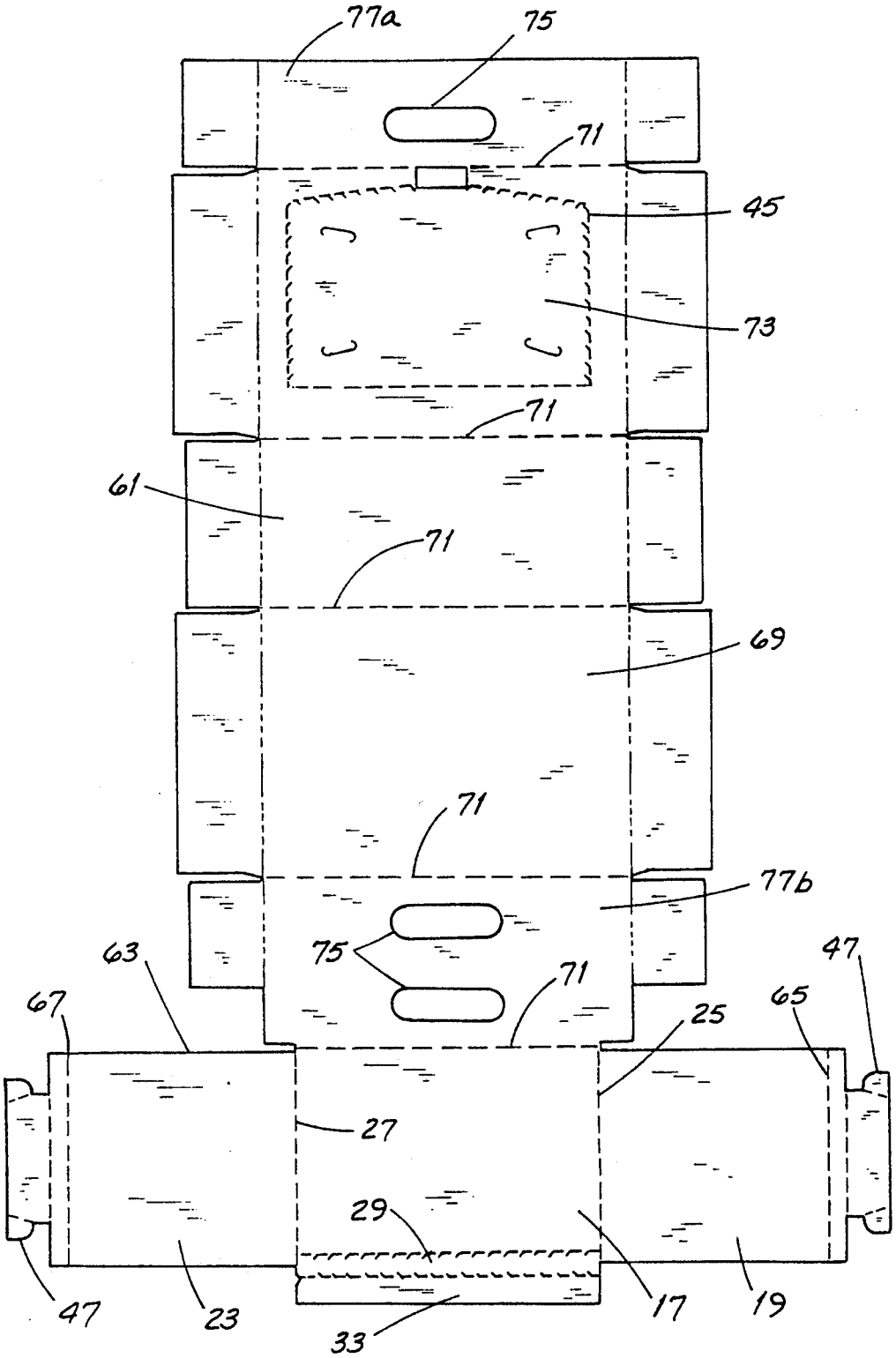
FIG. 8 is a plan view of a lightweight, generally T-shaped cardboard blank used to make the container of FIG. 1.

Referring now to FIG. 8, the carton 10 with integral ice bin 15*a* is preferably made from a one-piece, generally planar blank 61. The blank 61 includes a first panel portion 63 having fold lines 25, 27, 65, 67, plural contiguous panels 17, 19, 23, a retention strip 33 and a tearaway strip 29. When the carton 10 is set up to receive containers 11, the first panel portion 63 forms a side panel, e.g., the left or right side panel 17 or 21, and the two end panels 19, 23 with tabs 47.

A compartment portion 69 is directly attached to the first panel portion 63 and has fold lines 71 and a second panel portion 73 partly defined by scoring 45 for fold-out separation to a utility position. The compartment portion 69 includes "hand-hold" cutouts 75 so the set-up, filled carton 10 can be easily carried briefcase-fashion.

To make a carton 10, the blank 61 is folded along the fold lines 71 and the sections 77*a* and 77*b* glued together. The panels 19 and 23 are folded inward along fold lines 25 and 27 against the panel 17 and the retention strip 33 is glued in place as shown in FIGS. 1 and 2. The beverage carton so formed is of substantially conventional size. In a production operation, such folding, gluing and carton filling is by high speed automated machinery.

While the principles of this invention have been described in connection with specific embodiments, it should be understood clearly that these descriptions are made only by way of example and are not intended to limit the scope of the invention. One of ordinary skill will appreciate that a number of modifications of the invention are possible without departing from the spirit thereof. As examples, the carton 10 could be made of a two-piece or multiple-piece blank and/or the coolant bin 15*a* could be constructed of erectile panels 17, 19, 21, 23 differently configured, arranged or attached.

I claim:

1. In a carton having a compartment for multiple containers of beverage and holding means for retaining a coolant in heat exchange relationship to the containers, having a repose position and having a utility position, the improvement wherein:

the compartment has a top wall with a lift-up panel;

the holding means includes three additional panels atop the wall and in stacked relationship to one another in said repose position; none of said lift-up or additional panels is coplanar with another panel in said repose position;

at least one of the three additional panels is unattached to any other additional panel in said repose position;

at least one of the three additional panels includes a panel holding tab; and, at least one of the panels includes a slot for receiving a panel holding tab, the slot and the tab coacting for retaining all of the panels upright to define said utility position and forming an open-top ice bin atop the compartment.

2. The carton of claim 1 wherein each of the panels is generally planar irrespective of panel position.

3. The carton of claim 2 wherein no panel is folded upon itself, irrespective of panel position.

4. The carton of claim 1 wherein the holding means includes four panels, less than all of which are directly attached to the carton.

5. The carton of claim 4 wherein at least two panels are directly attached to the carton and wherein at least one panel is attached only to another panel.

6. The carton of claim 1 wherein:

one of the panels has a tear strip attached thereto and a retention strip attached to the tear strip; and, when the panels are in the repose position, the retention strip adheres to the top wall.

7. A one-piece, generally planar T-shaped carton blank including:

a longitudinally-extending compartment portion having an end and carton flaps spaced along the edges of the compartment portion;

a first panel portion including a side panel and a pair of end panels;

the side panel being attached to the end of the compartment portion and the end panels extending laterally from the side panel and beyond the flaps;

a retention strip;

a tearaway strip interposed between and attached to the side panel and the retention strip; and, the compartment portion includes a second panel portion scored along three edges for fold-out separation to a utility position.

8. The blank of claim 7 wherein:

the side panel, the end panels and the second panel portion are of substantially the same size;

each of the end panels includes a holding tab; and, the second panel portion includes slots for receiving the holding tabs.

9. The blank of claim 8 wherein the compartment portion includes a compartment top wall formed at least in part by one of the panels.

10. The blank of claim 9 wherein the top wall portion is formed at least in part by the right side panel.

11. In a carton having a compartment for multiple containers of beverage and holding means for retaining a coolant in heat exchange relationship to the containers, having a repose position and having a utility position, the improvement wherein:

the holding means includes left and right side panels and first and second end panels;

three of the panels are utility connected and contiguous;

the side panels are directly attached to the carton and at least one of the end panels is attached only to one of said side panels;

the panels are in stacked relationship to one another in said repose position;

at least one panel includes a holding tab and at least one other panel includes a slot for receiving the holding tab in said utility position.

12. The carton of claim 11 wherein each of the end panels is detachably coupled to the right side panel in the utility position, thereby forming the open-topped bin.

13. In a carton having a perimeter and including a compartment for multiple containers of beverage and a bin for retaining a coolant in heat exchange relationship to the containers, having a repose position and having a utility position, the improvement wherein:

the bin being atop the carton and includes a plurality of panels which, in said repose position, are in stacked relationship to one another;

the compartment includes a top wall which has a first area equal to the area bounded by said perimeter which is formed at least in part by one of the panels in the repose position;

said panels unfolding to a utility position to form the bin, that panel which, in said repose position, forms part of the top wall of the compartment becomes a side panel of the bin;

in the utility position, the side panel is attached to the remaining of the plurality of panels;

said plurality of panels form an open-top, coolant-receiving bin positioned atop the compartment, one of said panels being spaced inwardly of said perimeter such that the bin has a second area less than the first area.

14. The carton of claim 13 wherein the bin is volumetrically sized to receive a standard bag of ice.

15. In a carton having (a) a compartment for multiple containers of beverage, (b) a compartment bottom panel and (c) holding means for retaining a coolant in heat exchange relationship to the containers, having a repose position and having a utility position, the improvement wherein:

the carton includes four panels in stacked relationship to one another and are generally parallel to the compartment bottom panel in said repose position;

one of the panels is hingedly attached to any other of said panels when said panels are in the repose position;

no one of said panels is coplanar with another panel in said repose position;

the compartment has a top wall; and, said panels unfolding to a utility position, the panels being generally perpendicular to the top wall and interlock to form an open-top bin atop the compartment for receiving a coolant.

16. The carton of claim 15 wherein each of the panels is generally planar irrespective of panel position.

17. The carton of claim 16 wherein no panel is folded to itself, irrespective of panel position.

18. The carton of claim 15 wherein the holding means includes four panels, less than all of which are directly attached to the carton.

19. The carton of claim 18 wherein at least two panels are directly attached to the carton and wherein at least one panel is attached only to another panel.

* * * * *

UNITED STATES PATENT AND TRADEMARK OFFICE

CERTIFICATE OF CORRECTION

PATENT NO. : 5,303,863

DATED : April 19, 1994

INVENTOR(S) : James D. Arasim

It is certified that error appears in the above-indentified patent and that said Letters Patent is hereby corrected as shown below:

In column 8, line 46, after "position", a new sub-paragraph should begin with "none of said...".

In column 8, line 47, delete "or" and insert --and--.

In column 9, line 41, delete "utility" and insert --unitarily--.

In column 10, line 19, after "panels" insert --in said utility position--.

In column 15, line 36, delete "the" and insert --said--.

In column 15, line 41, after "said" insert --four--.

In column 15, line 41, delete "a" and insert --said--.

In column 15, line 10, "attached" should read --unattached--.

Signed and Sealed this

Twenty-fifth Day of October, 1994

*Attest:*

Bruce Lehman

BRUCE LEHMAN

*Attesting Officer*

*Commissioner of Patents and Trademarks*